US005522740A

United States Patent [19]

Plocek et al.

[11] Patent Number: 5,522,740

[45] Date of Patent: Jun. 4, 1996

[54] ELECTRICAL CONNECTOR WITH TERMINAL POSITION ASSURANCE DEVICE THAT FACILITATES FULLY INSERTING A TERMINAL

[75] Inventors: Edward J. Plocek, Lisle; Scott P. Marceau, Naperville; Thomas G. Premo, Downers Grove, all of Ill.

[73] Assignee: Molex Incorporated, Lisle, Ill.

[21] Appl. No.: 314,981

[22] Filed: Sep. 29, 1994

[51] Int. Cl.[6] ..... H01R 13/436

[52] U.S. Cl. ..... 439/752; 439/595

[58] Field of Search ..... 439/752, 595

[56] References Cited

U.S. PATENT DOCUMENTS

| | | | |
|---|---|---|---|
| 4,944,688 | 7/1990 | Lundergan | 439/752 |
| 4,955,827 | 9/1990 | Roy et al. | 439/595 |
| 5,120,269 | 6/1992 | Endo et al. | 439/752 |
| 5,205,763 | 4/1993 | Watanabe et al. | 439/752 |
| 5,209,676 | 5/1993 | Endo et al. | 439/595 |

*Primary Examiner*—Gary F. Paumen
*Attorney, Agent, or Firm*—A. A. Tirva

[57] ABSTRACT

An electrical connector includes a dielectric housing having a forward mating end and a rearward terminating end and at least one terminal-receiving cavity extending in a direction between the ends. A terminal is insertable into the cavity from the rearward terminating end of the housing. A TPA device is selectively engageable with the housing at the terminating end thereof, with a terminal retention portion insertable into the cavity in locking engagement with the terminal. An abutment shoulder on the TPA device engages an aperture in the terminal for moving the terminal from at least one incomplete position of insertion to a fully inserted position in response to engaging the TPA device with the housing and fully inserting the terminal into the cavity.

11 Claims, 7 Drawing Sheets

ELECTRICAL CONNECTOR WITH TERMINAL POSITION ASSURANCE DEVICE THAT FACILITATES FULLY INSERTING A TERMINAL

FIELD OF THE INVENTION

This invention generally relates to the art of electrical connectors and, particularly, to an electrical connector which incorporates an improved position assurance device that not only detects an incompletely inserted terminal but moves the incompletely inserted terminal to its fully inserted position.

BACKGROUND OF THE INVENTION

Generally, an electrical connector includes a dielectric housing mounting at least one electrically conductive terminal therein. The terminal is electrically connected to another circuit component, such as a discrete wire. Connectors often are employed in mateable pairs such that each terminal and the housing of one connector are mateable with a corresponding terminal and the housing of another connector.

The terminals of electrical connectors frequently are very small components, such as components that are stamped and/or formed from thin sheet metal material. A poor quality electrical connection may occur if one or more terminals are not properly seated in its respective housing. The improper seating of a terminal in a housing may occur if the terminal is not fully inserted into the housing during the initial assembly of the connector or if the terminal is vibrated or pulled out of its fully seated condition during use of the connector. Failures of this type are a particular concern in the automotive industry where electrical components are subjected to vibration almost continuously during normal usage and are subjected to direct force during some maintenance. To avoid these problems, the automotive industry often requires connectors to be provided with some form of a terminal position assurance (TPA) system to detect incomplete insertion of the terminals. The automotive industry also generally requires locking means for locking the terminals in the housing, and a TPA system or device also performs this function.

In using a typical TPA device, if the device detects that one or more terminals are not fully seated, a search is required to locate the incompletely inserted terminal(s). This can be a time consuming operation and adds to the cost of the connector assembly operation. The present invention is directed to solving this problem by providing a TPA device which not only detects an incompletely inserted terminal, but the device, itself, is used to move the incompletely inserted terminal to its fully inserted position.

SUMMARY OF THE INVENTION

An object, therefore, of the invention is to provide an electrical connector with a new and improved terminal position assurance (TPA) device that not only detects whether or not a terminal is fully inserted and not only locks a terminal in its fully inserted position but facilitates moving an incompletely inserted terminal to its fully inserted position.

In the exemplary embodiment of the invention, the connector includes a housing having a forward mating end and a rearward terminating end and at least one terminal-receiving cavity extending in a direction between the ends. A terminal is insertable into the cavity from the rearward terminating end of the housing. A TPA device is selectively engageable with the housing at the mating end thereof, with a terminal retention portion of the device insertable into the cavity in locking engagement with the terminal. Complementary interengaging abutment means are provided between the terminal and the TPA device for moving the terminal from at least one incomplete position of insertion to a fully inserted position in response to engaging the TPA device with the housing and fully inserting the terminal portion into the cavity.

As disclosed herein, the retention portion of the TPA device is provided by a flexible locking arm having an abutment shoulder for engaging the terminal. The abutment shoulder, in turn, forms part of the complementary interengaging abutment means which also includes an aperture in the terminal engageable by the abutment shoulder.

The connector further includes a primary locking means in the form of a second flexible locking arm inside the cavity. The second arm includes a locking shoulder for locking engagement with another aperture in the terminal when in its fully inserted position.

In the preferred embodiment of the invention, the TPA device is selectively engageable with the housing in two positions, preloaded and fully loaded. When the TPA device is in its preloaded position, the terminal can be inserted into the cavity. When the TPA device is in its fully loaded position, the retention portion locks the terminal in its fully inserted position. When the TPA device is moved from the preloaded position to the fully loaded position, the complementary interengaging abutment means engage the terminal if in its incomplete position of insertion and moves the terminal to its fully inserted position.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
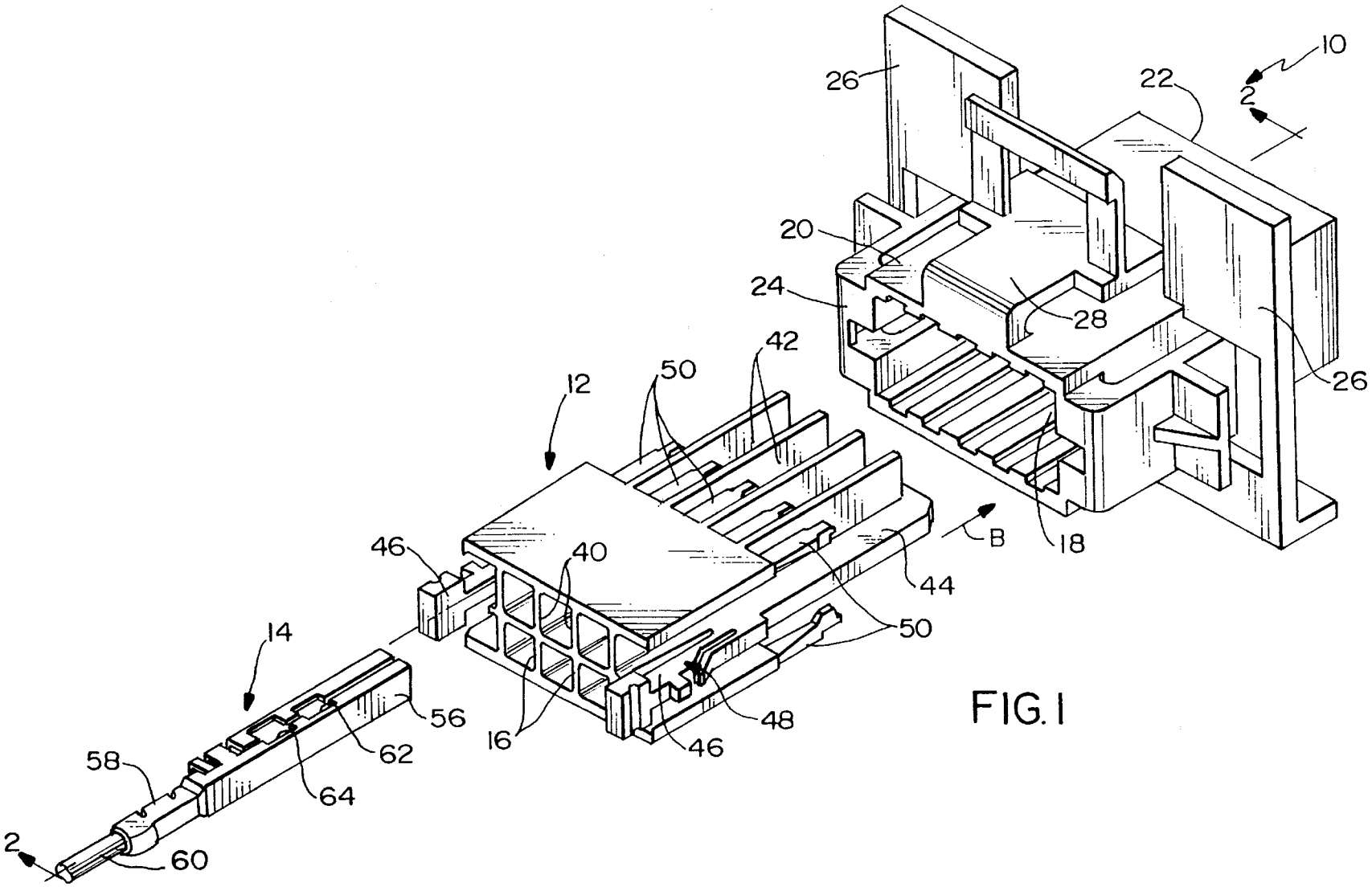
FIG. 1 is an exploded perspective view of an electrical connector assembly, including a TPA device, embodying the concepts of the invention.
Figure 2:
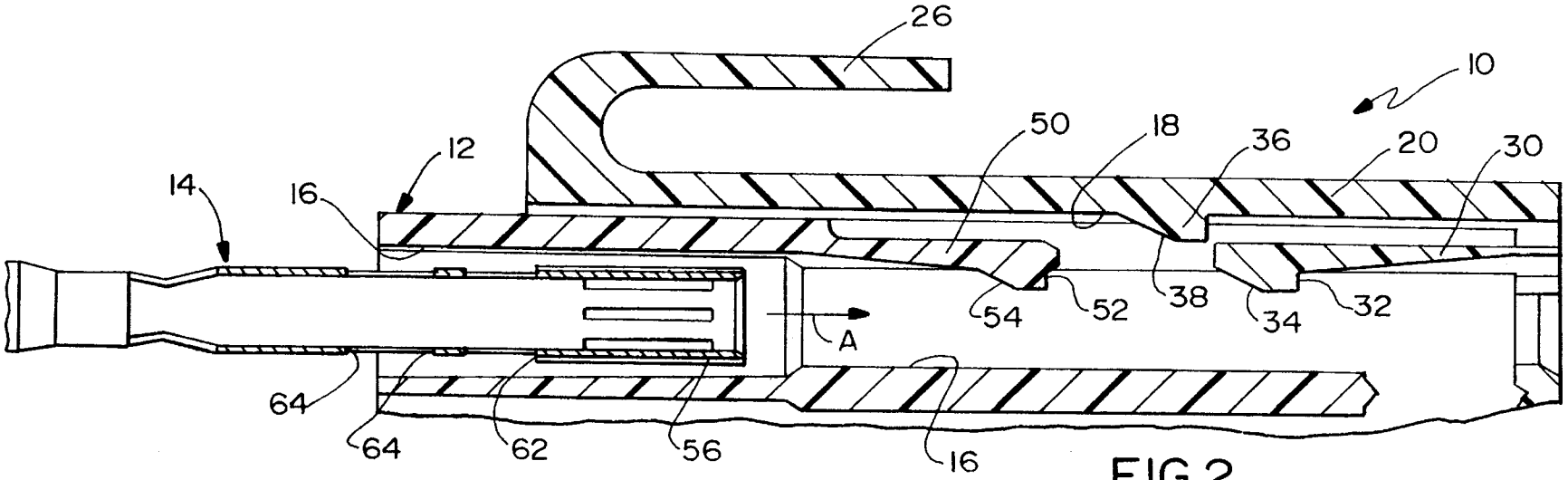
FIG. 2 is a vertical section taken generally along line 2—2 of FIG. 1, but with the TPA device assembled to the connector in its preloaded position and with the terminal just partially inserted.

Referring to the drawings in greater detail, and first to FIGS. 1 and 2, the invention is embodied in an electrical connector, generally designated 10, which includes a TPA device, generally designated 12, selectively engageable with the connector. A plurality of terminals, generally designated 14, are inserted through passages 16 in the TPA device and into a terminal-receiving cavity 18 of the connector. Only one terminal is shown in the drawings to avoid cluttering a clear depiction of the invention. As will be understood hereinafter, TPA device 12 is adapted for insertion into terminal-receiving cavity 18 of connector 10, and terminals 14 then are inserted into passages 16 of the TPA device and further into cavity 18 of the connector.

More particularly, connector 10 includes a housing 20 having a forward mating end 22 and a rearward terminating end 24. The housing is unitarily molded of dielectric material, such as plastic or the like, and cavity 18 extends between mating end 22 and terminating end 24 of the housing. Although not forming part of the invention, connector housing 20 also includes integral side flanges 26 to facilitate mounting the connector in a panel, and latch means 28 for latching the connector to a complementary mating connector or other connecting device.

As seen best in FIG. 2, connector housing 20 has a primary locking means within cavity 18, in the form of a flexible locking arm 30 having a forwardly facing locking shoulder or hook 32. The distal end of the locking arm is chamfered, as at 34, to present a rearwardly facing angled surface to terminal 14 oblique to an insertion direction "A" of the terminal. A camming boss 36 also is formed integral with connector housing 20 within cavity 18. The camming boss also forms a rearwardly facing angled surface 38 extending oblique to insertion direction "A".

Referring back to FIG. 1, TPA device 12 includes rear walls 40 and front partitions 42 for separating terminal-receiving passages 16. It can be seen that there are two rows of passages divided transversely of the TPA device by a central wall 44. Cantilevered latch arms 46 are provided at opposite sides of the TPA device for gripping and squeezing by a technician to facilitate inserting the TPA device into cavity 18 of connector housing 20 in the direction of arrow "B". Latch means, generally designated 48, are provided, operatively associated with latch arms 46, for latching the TPA device within the cavity in cooperation with complementary latching means (not shown) therewithin.

Referring to FIG. 2 in conjunction with FIG. 1, TPA device 12 includes a flexible locking arm 50 located within and projecting forwardly of each terminal-receiving passage 16. The locking arm has a forwardly facing abutment shoulder 52 on the distal end thereof. A chamfered surface 54 faces rearwardly behind the distal end of the locking arm at an angle to insertion direction "A" of the terminal.

Terminal 14 has a forward mating end 56 and a rearward terminating end 58. The forward mating end is generally box-shaped for defining a receptacle to receive a mating male terminal of the complementary connecting device. Terminating end 58 is adapted for crimping onto an electrical wire or cable 60. The terminal includes a forward locking aperture 62 adapted for locking engagement with primary locking arm 30 within cavity 18 of connector housing 20. The terminal includes a second or rear locking aperture 64 for locking engagement with locking arm 50 of TPA device 12 within passage 16 of the device. It should be observed in FIG. 1 that forward locking aperture 62 is smaller in a transverse direction than rear locking aperture 64. To that end, the distal end of locking arm 50 of the TPA device (i.e. at locking shoulder 52 and chamfered surface 54) is wider than forward locking aperture 62 so that the locking arm of the TPA device simply will ride over the top surface of the terminal past forward locking aperture 62. In turn, the forward locking aperture is sized for receiving the forward hooked end of primary locking arm 30.

In operation of the invention, including connector 10, TPA device 12 and terminal(s) 14, FIG. 2 shows the TPA device selectively engaged with connector housing 20, inserted into cavity 18 and located in a preloaded position of the TPA device. Terminal 14 is shown being initially inserted into passage 16 of the TPA device.

Figure 3:
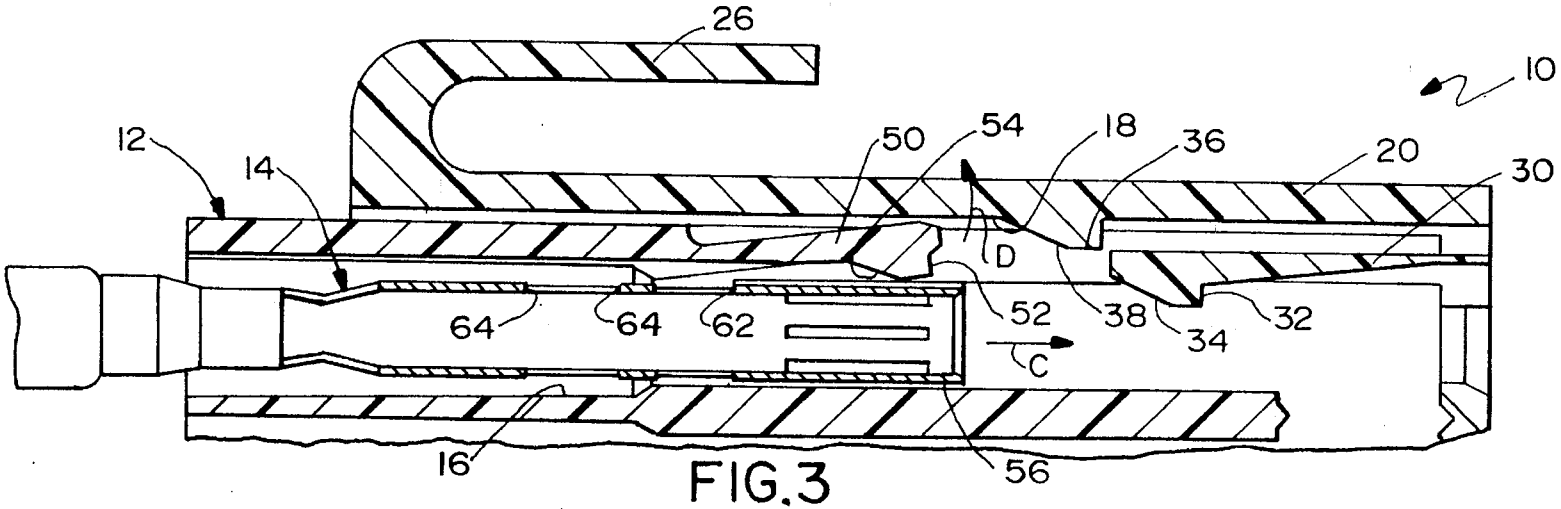
FIG. 3 is a view similar to that of FIG. 2, but with the terminal inserted further such that the mating end thereof is in engagement with and deflecting the locking arm of the TPA device.

FIG. 3 shows terminal 14 having been inserted further in the direction of arrow "C" to a point whereat the mating end 56 of the terminal has biased flexible locking arm 50 upwardly in the direction of arrow "D". The arm is flexed upwardly by the mating end of the terminal engaging chamfered surface 54 of the locking arm. It should be noted that there is adequate space within cavity 18 for the locking arm of the TPA device to fully flex while the device is in its preloaded position.

Figure 4:
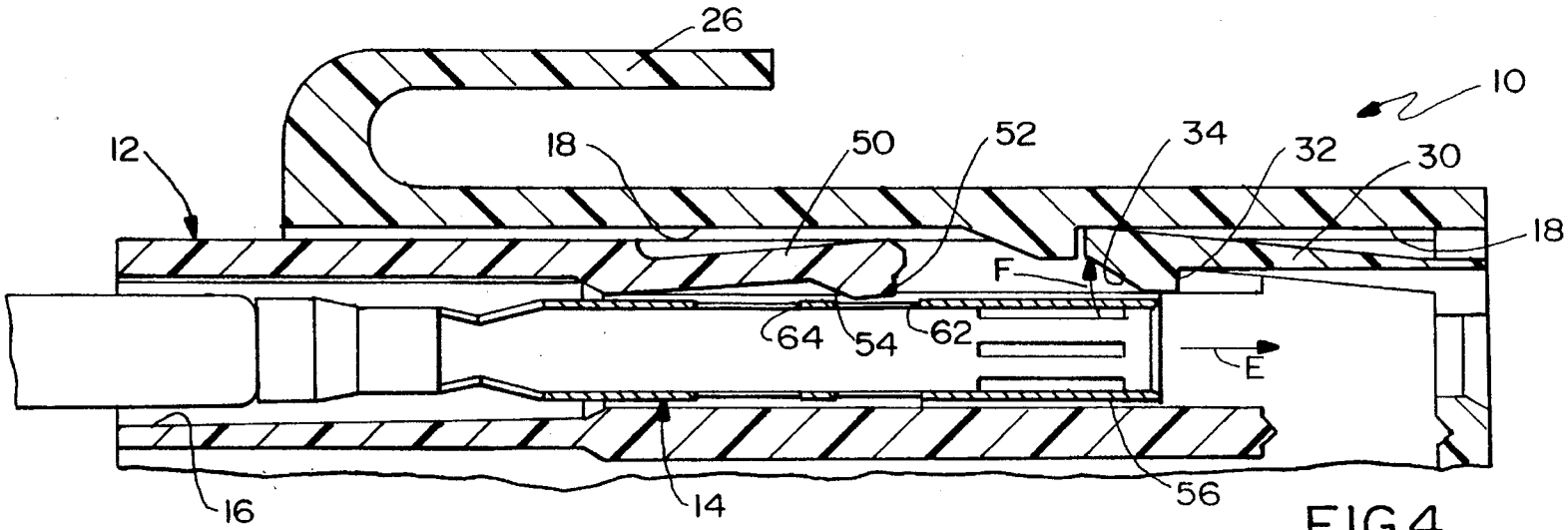
FIG. 4 is a view similar to that of FIG. 3, but with the terminal inserted further to a position of engagement with the primary locking arm of the connector.

FIG. 4 shows terminal 14 having been inserted further in the direction of arrow "E" whereat the mating end 56 of the terminal now has engaged primary locking arm 30 and has flexed the locking arm upwardly in the direction of arrow "F". The arm is flexed upwardly by engagement of the mating end of the terminal with chamfered surface 34 of the primary locking arm. It also can be seen in FIG. 4 that locking arm 50 of TPA device 12 has not dropped into forward locking aperture 62 of the terminal, because, as stated above, the distal end of the locking arm is wider than the smaller aperture and simply will ride over the aperture along the top surface of the terminal.

Figure 5:
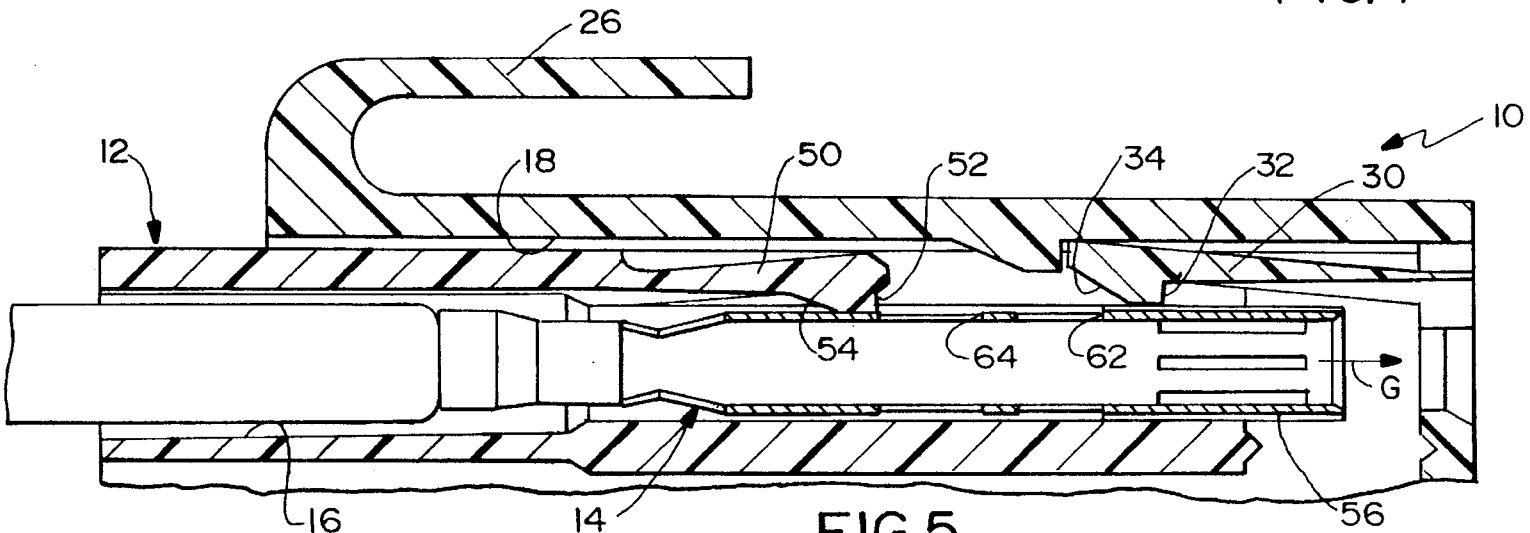
FIG. 5 is a view similar to that of FIG. 4, but with the terminal inserted further to a position wherein both apertures in the terminal have passed the locking arm of the TPA device.

FIG. 5 shows terminal 14 having been inserted still further in the direction of arrow "G" but not yet to its fully inserted position. TPA device 12 still is in its preloaded position, and primary locking arm 30 of connector 10 and locking arm 50 of the TPA device still are in their flexed positions.

Figure 6:
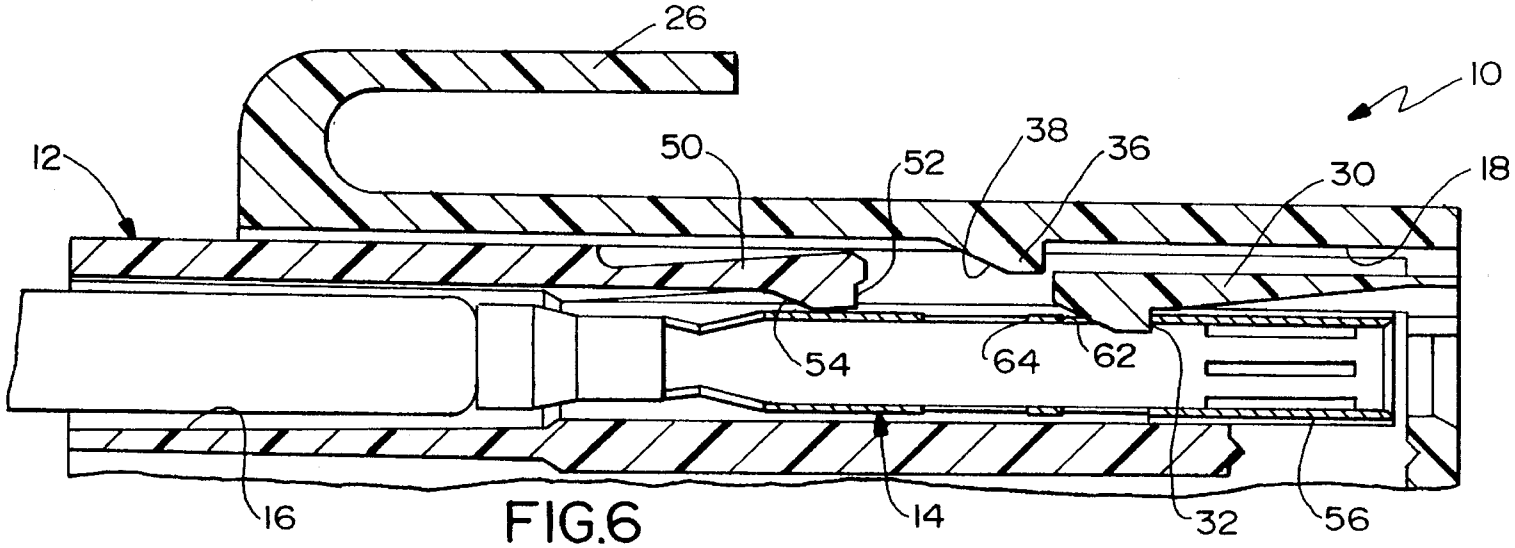
FIG. 6 is a view similar to that of FIG. 5, but with the terminal in its fully inserted position in engagement with the primary locking arm of the connector.

FIG. 6 now shows terminal 14 having been inserted to its fully inserted position. Primary locking arm 30 now has returned or "snapped" back downwardly such that locking shoulder 32 now has interengaged into locking condition within forward locking aperture 62 of the terminal. The TPA device still is in its preloaded position.

Figure 7:
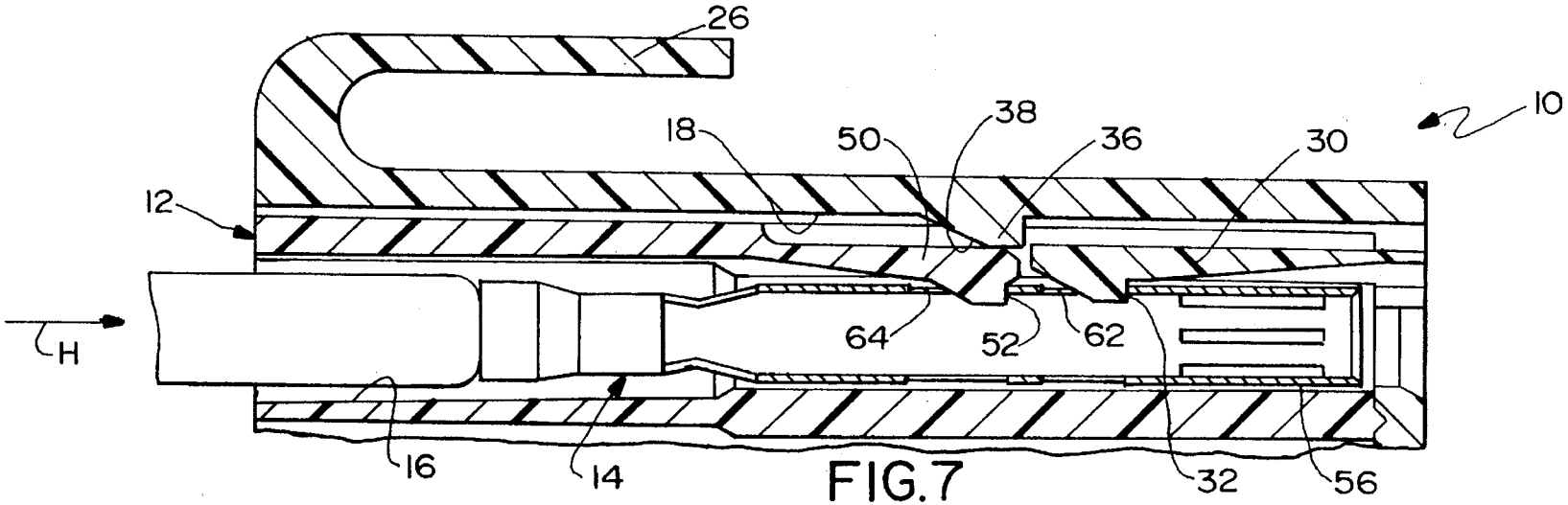
FIG. 7 is a view similar to that of FIG. 6, but with the TPA device moved to its fully loaded position.

FIG. 7 is similar to FIG. 6 in that the terminal is in its fully inserted position in locking engagement with primary locking arm 30. However, TPA device 12 now has been moved in the direction of arrow "H" to its fully loaded and locking position. It can be seen that locking arm 50 of the TPA device has returned or "snapped" back to its unflexed condition, and abutment shoulder 52 is in locking position within rear aperture 64 of the terminal. During movement of the TPA device from its preloaded position (FIGS. 2–6) to its loaded and locking position (FIG. 7), the distal end of locking arm 50 engages angled surface 38 of camming boss 36, and the angled surface facilitates biasing abutment shoulder 52 into aperture 64 of the terminal. In the fully loaded position of the TPA device as shown in FIG. 7, it can be seen that camming boss 36 provides a backing for locking arm 50.

Figure 8:
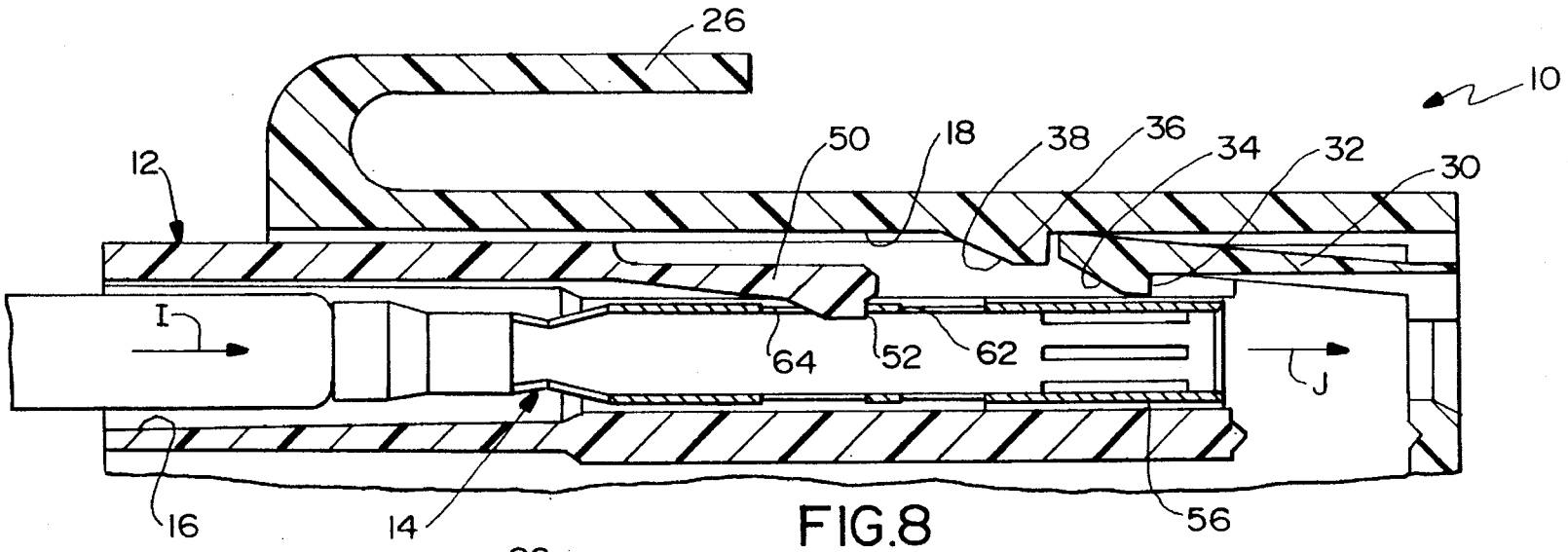
FIG. 8 is a view similar to that of FIGS. 2–7, but with the TPA device engaging an incompletely inserted terminal.

FIG. 8 shows a condition wherein terminal 14 has been inserted into an incomplete position of insertion. With TPA devices of the prior art, such an incompletely inserted terminal would require a technician to search to find which terminal or terminals is incompletely inserted. Such a process wastes considerable time and money in the assembly operation of the connector. However, with TPA device 12 of the invention being in its preloaded position, it can be seen that abutment shoulder 52 on the distal end of locking arm 50 has entered rear aperture 64 of the terminal. Now, upon movement of the TPA device in the direction of arrow "I" the combination of the TPA device along with the terminal (the abutment shoulders 52 on the flexible locking arm 50 engages an edge of the terminal aperture 64) will move in the direction of arrow "J" until the terminal reaches its fully inserted position as shown in FIG. 7. Therefore, the TPA device is effective to "correct" situations of incompletely inserted terminals by moving the terminals with the TPA device from its preloaded position to its loaded position (i.e. from the position of FIG. 8 to the position of FIG. 7).

FIG. 8 shows just one incomplete position of insertion of terminal 14 whereupon TPA device 12 is effective to fully insert the terminal when the TPA device is moved from its preloaded position to its loaded position. Other incomplete positions of insertion of the terminal can range from the position shown in FIG. 8 all the way to the position of the terminal shown in FIG. 6. In any position therebetween, movement of the TPA device forwardly will cause abutment shoulder 52 to engage within rear locking aperture 64 of the terminal and move the terminal forwardly with the TPA device.

Figure 9:
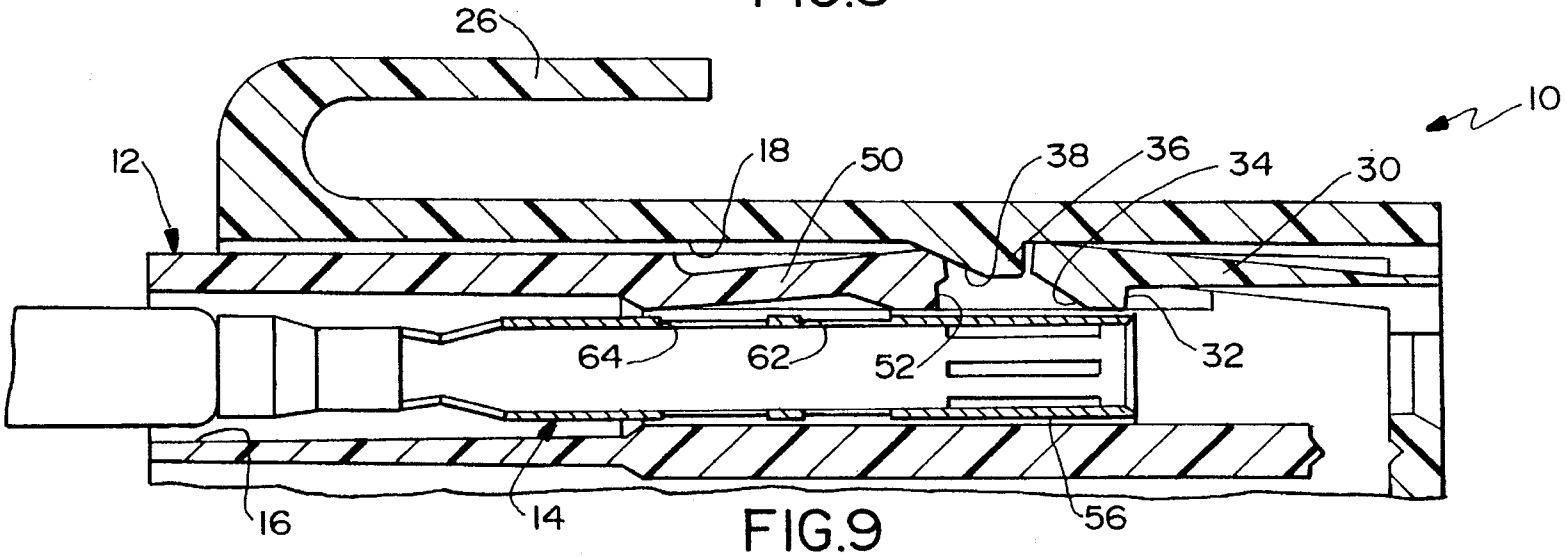
FIG. 9 is a view similar to that of FIGS. 1–8, but showing a terminal in an inadequately inserted position.

On the other hand, FIG. 9 shows a position of terminal 14 wherein the terminal is so incompletely inserted (i.e. too far to the rear) that TPA device 12 would be ineffective. In other words, it can be seen in FIG. 9 that the terminal is so far to the rear that the forward distal end of locking arm 50 simply will abut against angled surface 38 of camming boss 16 and jam between the surface and top wall of the terminal.

Figure 10:
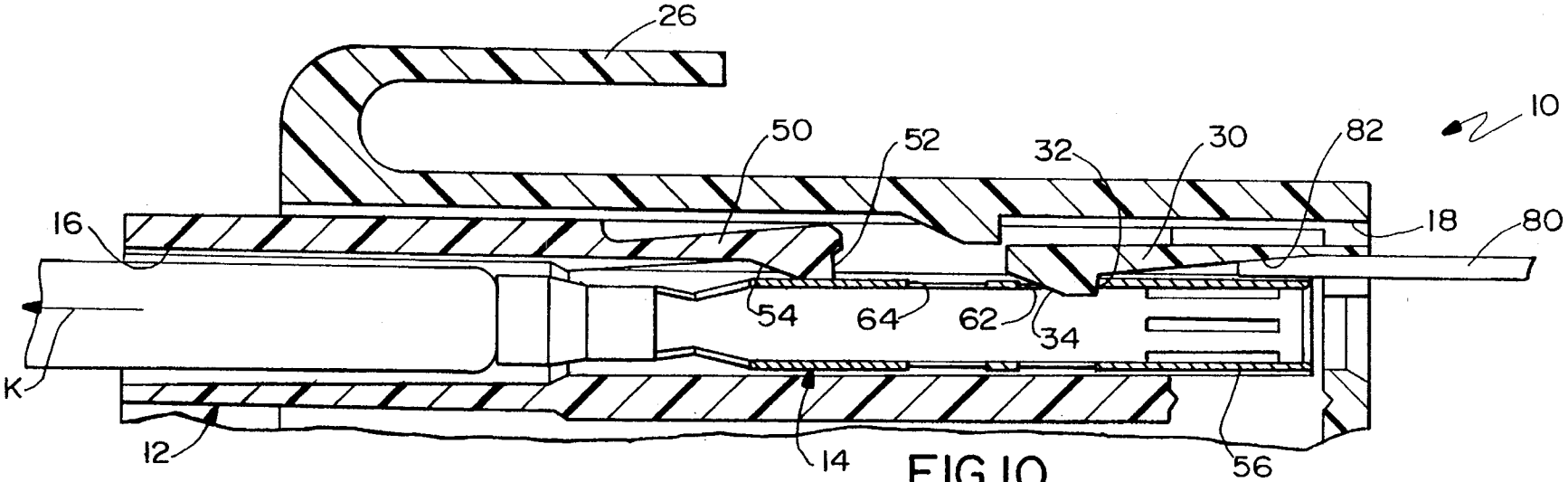
FIG. 10 is a view similar to that of FIGS. 2–9, but with the TPA device withdrawn back to its preloaded position and a probe is inserted for releasing the primary locking arm.
Figure 11:
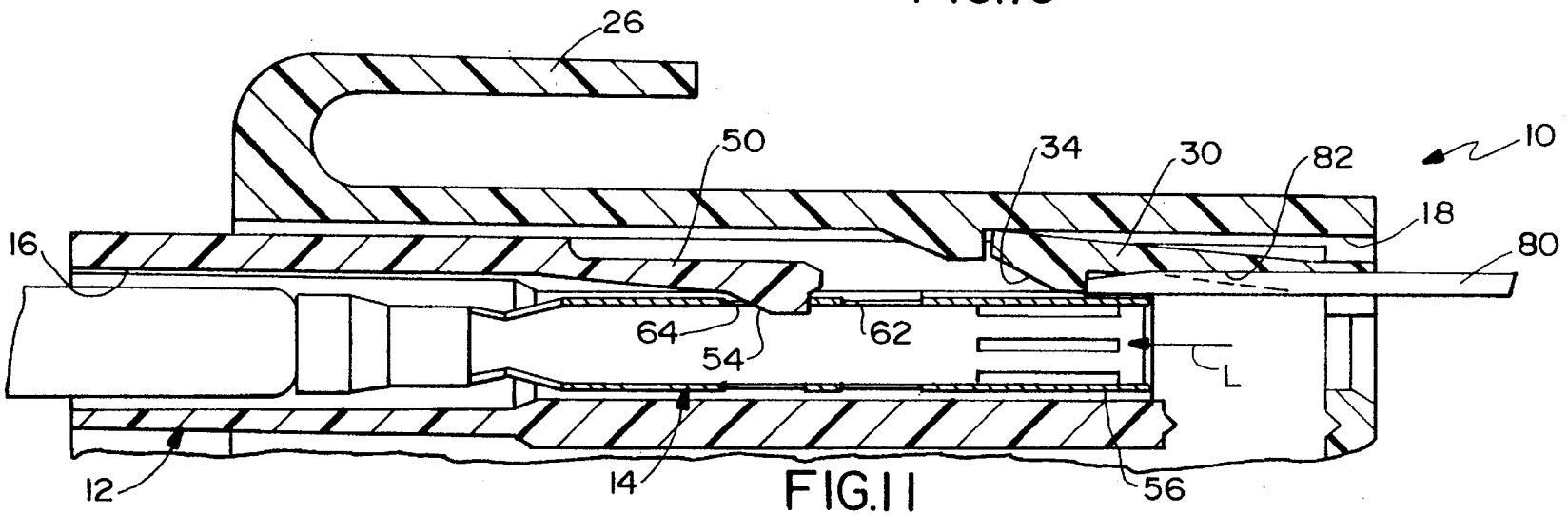
FIG. 11 is a view similar to that of FIG. 10 with the probe inserted further to release the primary locking arm and the terminal withdrawn from its fully inserted position.

Lastly, FIGS. 10–13 show a procedure for selectively withdrawing one or more of terminals 14 from connector 10. In particularly, FIG. 10 shows that TPA device 12 has been moved back rearwardly in the direction of arrow "K" to its preloaded position. During this movement, chamfered surface 54 on the underside of locking arm 50 simply will ride upwardly and over the rear edge of locking aperture 64 as the TPA device is moved back to its preloaded position. A probe-like tool 80 then can be inserted into cavity 18 into engagement with a rear chamfered surface 82 of primary locking arm 30 to lift locking shoulder 52 of the arm out of locking aperture 62 of the terminal as seen in FIG. 11. The terminal then can be moved away from its fully inserted position in the direction of arrow "L" out of locking condition with the primary locking arm, as is seen in FIG. 11.

Figure 12:
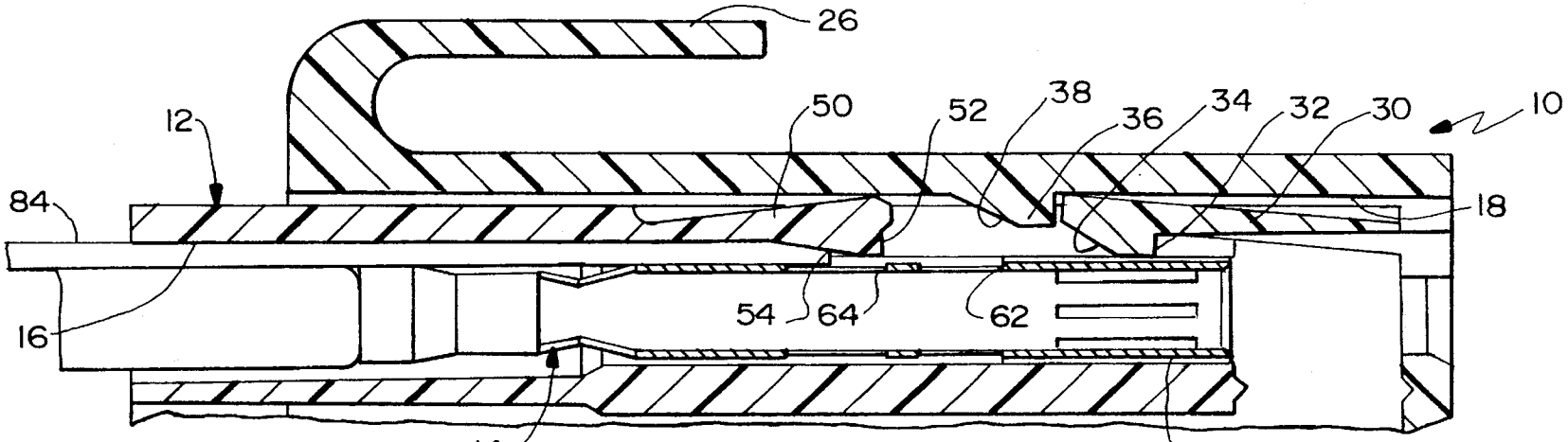
FIG. 12 is a view similar to that of FIG. 11, but with a second probe inserted for releasing the TPA locking arm.
Figure 13:
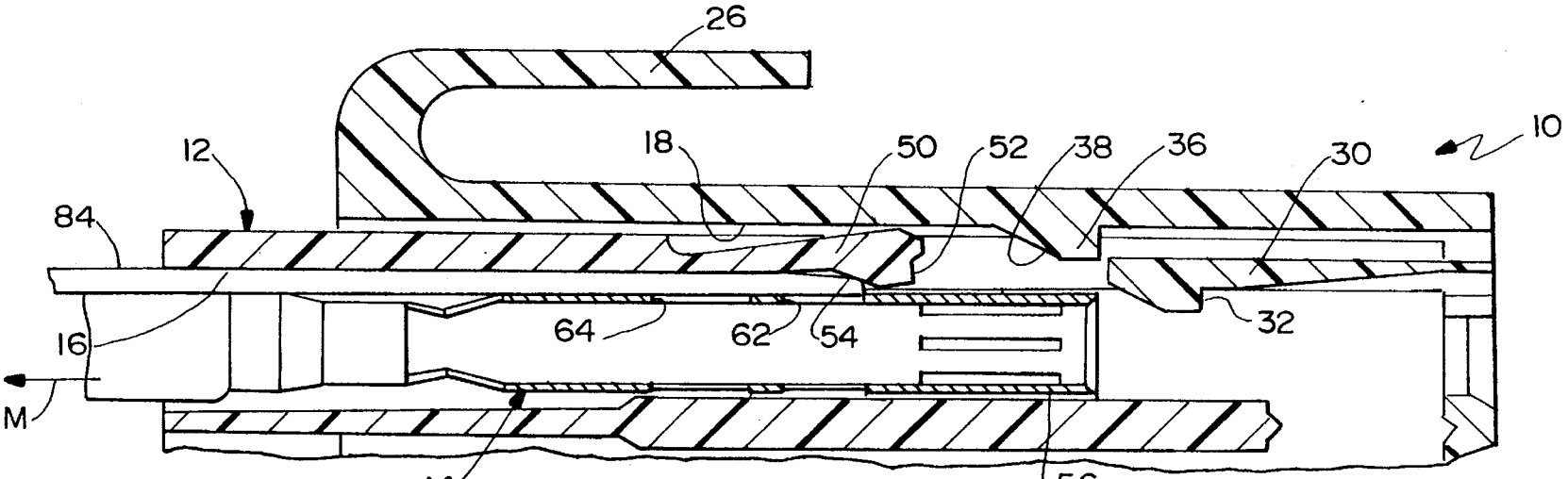
FIG. 13 is a view similar to that of FIG. 12, but showing the terminal being fully withdrawn.

FIG. 12 shows that a second probe 84 then can be inserted into passage 16 and into engagement with angled surface 54 on the underside of TPA locking arm 50 to lift the arm out of locking engagement with the terminal, as shown. The terminal now is free to be fully withdrawn in the direction of arrow "M" in FIG. 13.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector, comprising:

a housing having a forward mating end and a rearward terminating end and at least one terminal-receiving cavity extending in a direction between the ends, the cavity having a rear open end at the rearward terminating end of the housing;

a terminal insertable into the cavity from the rearward terminating end of the housing;

a TPA device selectively engageable with the housing at said terminating end thereof with a terminal retention portion insertable into the rear open end of the cavity in locking engagement with the terminal; and complementary interengaging abutment means between the terminal and the TPA device for moving the terminal from at least one incomplete position of insertion to a fully inserted position in response to engaging the TPA device with the housing and fully inserting the terminal retention portion into the cavity; and a primary locking means on the housing apparatus with the terminal for locking the terminal in its fully inserted position.

2. The electrical connector of claim 1 wherein said complementary interengaging abutment means include an abutment portion on the retention portion of the TPA device.

3. The electrical connector of claim 2 wherein said abutment portion of the TPA device includes an abutment shoulder for engaging the terminal, the abutment shoulder, in turn, comprising part of said complementary interengaging abutment means.

4. The electrical connector of claim 3 wherein said retention portion of the TPA device comprises a flexible locking arm having said abutment shoulder thereon.

5. The electrical connector of claim 4 wherein said complementary interengaging abutment means include an aperture in the terminal engageable by said abutment shoulder.

6. The electrical connector of claim 1 wherein said primary locking means comprise a flexible locking arm inside the cavity and including a locking shoulder for locking engagement within an aperture in the terminal when in its fully inserted position.

7. The electrical connector of claim 1 wherein said TPA device is selectively engageable with the housing in two positions, preloaded and fully loaded, wherein when the TPA device is preloaded the terminal can be inserted into the cavity, when the TPA device is fully loaded the retention portion locks the terminal in its fully inserted position, and when the TPA device is moved from the preloaded position to the fully loaded position the complementary interengaging abutment means engage the terminal if in its incomplete position of insertion and moves the terminal to its fully inserted position.

8. The electrical connector of claim 1 wherein said TPA device includes a terminal-receiving passage aligned with the terminal-receiving cavity of the housing.

9. An electrical connector, comprising:

a housing having a forward mating end and a rearward terminating end and at least one terminal-receiving cavity extending in a direction between the ends, the cavity having a rear open end at the rearward terminating end of the housing;

a terminal insertable into the cavity from the rearward terminating end of the housing, the terminal including an abutment means thereon;

a TPA device selectively engageable with the housing at said terminating end thereof and including a terminal retention portion insertable into the rear open end of the cavity, the retention portion having an abutment shoulder for engaging the abutment means of the terminal whereby the TPA device moves the terminal from at least one incomplete position of insertion to a fully inserted position in response to engaging the TPA device with the housing;

a flexible primary locking arm inside the cavity and including a locking shoulder for locking engagement within an aperture in the terminal when in its fully inserted position; and said TPA device is selectively engageable with the housing in two positions, preloaded and fully loaded, wherein when the TPA device is preloaded the terminal can be inserted into the cavity, when the TPA device is fully loaded the abutment shoulder locks the terminal in its fully inserted position, and when the TPA device is moved from the preloaded position to the fully loaded position the abutment shoulder engages the abutment means of the terminal if in its incomplete position of insertion and moves the terminal to its fully inserted position.

10. The electrical connector of claim 9 wherein said TPA device includes a flexible locking arm having said abutment shoulder thereon.

11. The electrical connector of claim 9, including a primary locking means on the housing engageable with the terminal for locking the terminal in its fully inserted position.

* * * * *